United States Patent [19]

Swanson

[11] 4,345,763

[45] Aug. 24, 1982

[54] GOLF CLUB

[76] Inventor: Arthur P. Swanson, 1454 Estate La., Glenview, Ill. 60025

[21] Appl. No.: 328,633

[22] Filed: Dec. 8, 1981

[51] Int. Cl.[3] ..... A63B 53/00

[52] U.S. Cl. ..... 273/164; 273/167 J; 273/80 C; 273/169

[58] Field of Search ..... 273/167 K, 169, 168, 273/167 D, 167 G, 167 J, 167 R, 167 A, 167 F, 164, 163 R, 183 D

[56] References Cited

U.S. PATENT DOCUMENTS

| | | | |
|---|---|---|---|
| D. 90,924 | 10/1933 | Replogle | 273/164 |
| D. 207,227 | 3/1976 | Solheim | 273/167 D |
| D. 208,984 | 10/1967 | Huelsman et al. | 273/167 D |
| 786,268 | 4/1905 | Corey et al. | 273/164 |
| 1,525,148 | 2/1925 | Pickop | 273/167 G |
| 1,550,501 | 8/1925 | Byrne | 273/167 G |
| 2,088,095 | 7/1937 | Sargent et al. | 273/80 C |
| 2,174,212 | 9/1939 | Newsome | 273/169 |
| 2,683,036 | 7/1954 | Klein | 273/80 |
| 3,077,350 | 2/1963 | Koorland | 273/164 |
| 3,088,736 | 5/1963 | Mospan | 273/167 G |
| 3,360,268 | 12/1967 | Molinari | 273/186 |
| 3,595,582 | 7/1971 | Chapman | 273/183 D |
| 3,858,886 | 1/1975 | Cosby | 273/167 F |
| 3,923,308 | 12/1975 | Mills | 273/183 D |
| 3,947,041 | 3/1976 | Barber | 273/167 G |
| 3,981,507 | 9/1976 | Nunziato | 273/164 |
| 3,995,864 | 12/1976 | Cochran et al. | 273/164 |
| 4,128,244 | 12/1978 | Duclos | 273/164 |
| 4,211,416 | 7/1980 | Swanson | 273/164 |

FOREIGN PATENT DOCUMENTS

| | | | |
|---|---|---|---|
| 1232651 | 5/1971 | United Kingdom | 273/80 C |

*Primary Examiner*—George J. Marlo

*Attorney, Agent, or Firm*—Hill, Van Santen, Steadman, Chiara & Simpson

[57] ABSTRACT

A lofted iron golf club, such as a pitching wedge, has a substantially rectangular head or blade with substantially parallel top and bottom edges arranged so that the top edge is visible to the golfer to facilitate alignment of the club for the intended flight path of the ball even when the lower portion of the blade is buried in the grass. The toe and heel ends of the head or blade have substantially the same height to provide an enhanced size striking face. The head or blade has a hosel joined to the lower portion of the heel through a widened and curved land and the hosel is inclined forwardly from the blade face and laterally away from the heel end of the blade.

11 Claims, 7 Drawing Figures

GOLF CLUB

BACKGROUND OF THE INVENTION

1. Field of the Invention

This invention relates to iron type golf clubs, particularly of the high loft pitching type, and specifically deals with the so-called short irons such as pitching wedges and the like which provide a large striking face and have a top visible sighting line for aligning the club to impact the ball along an intended flight path.

2. Prior Art

My prior U.S. Pat. No. 4,211,416 issued July 8, 1980, discloses a lofted golfing iron with an integral ledge extending rearwardly from the back face of the blade along the top of the blade to define a rear sighting edge which is parallel with the front edge of the sole of the blade. This rear sighting edge permits the golfer to align the striking face of the blade normal to the intended flight path of the ball even when the bottom portion of the blade is hidden in the grass. The ledge increases in front to rear depth from the toe toward the heel end of the blade but does not increase the striking face area of the blade.

It would be an improvement in the art to provide a sighting edge of the type disclosed in my aforesaid patent without a rearwardly extending ledge or flange and it would be a further improvement in the art to increase the striking face area of the blade in providing this sighting edge.

SUMMARY OF THE INVENTION

This invention now provides a sighting line for the blades or heads of lofted golfing irons of the type disclosed and claimed in my aforesaid U.S. Pat. No. 4,211,416 but eliminating the rearwardly extending ledge, disclosed in the patent, and at the same time increasing the striking face of the blade.

According to this invention, the head or blade of the club is made substantially rectangular with heel and toe ends of substantially the same height and with parallel top and bottom front edges. A hosel for the club shaft is integrally connected to the heel end of the blade through a flattened land extending from the bottom or sole of the blade and curved forwardly to the cylindrical hosel. The shaft carried by the hosel is inclined forwardly of the rearwardly inclined striking face of the blade and rearwardly from the heel end of the blade.

The sighting edge of the golfing irons disclosed and claimed in my aforesaid U.S. Pat. No. 4,211,416 is thus obtained without the rearward flange, and at the same time the striking face of the blade is increased in size to provide a larger target area for impacting the ball.

It is then an object of this invention to improve the golfing irons disclosed and claimed in my U.S. Pat. No. 4,211,416.

Another object of the invention is to provide a lofted golfing iron with a substantially rectangular blade having parallel top and bottom front edges constructed and arranged so that the top edge is thin and provides a true sight line when addressing the ball.

Another object of the invention is to provide a pitching wedge type golf club with a relatively thin top edge parallel to the bottom edge of the striking face to provide a sighting line for properly addressing the ball.

A specific object of the invention is to provide a pitching wedge with a substantially rectangular blade having heel and toe ends with substantially the same height and parallel top and bottom edges and with a hosel inclined forwardly and rearwardly from the blade and connected to the blade through an integral land merged into the bottom portion of the heel of the blade.

Other and further objects of this invention will become apparent to those skilled in this art from the following detailed description of the annexed sheet of drawings showing a preferred embodiment of the invention and a modification thereof.

ON THE DRAWINGS

AS SHOWN ON THE DRAWINGS

Figure 1:
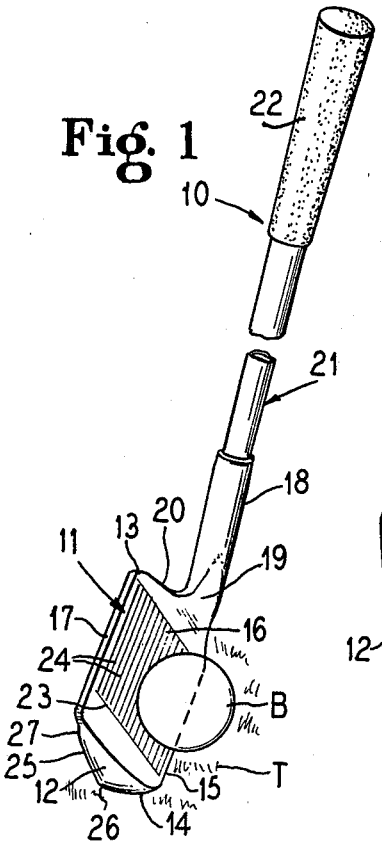
FIG. 1 is a perspective view of a pitching wedge of this invention in position for addressing a golf ball in the turf normal to the intended flight path of the ball and showing the parallel relationship between the bottom edge of the striking face and the top edge of the blade or head.
Figure 2:
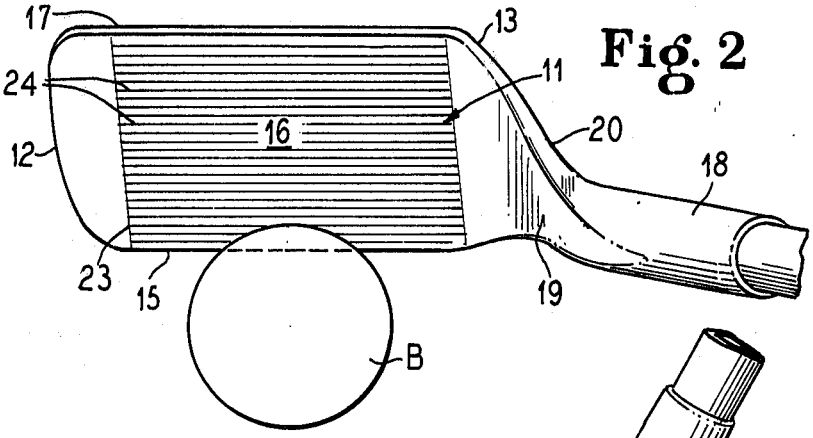
FIG. 2 is a plan view of a golfing iron of FIG. 1 with the shaft broken away.
Figure 3:
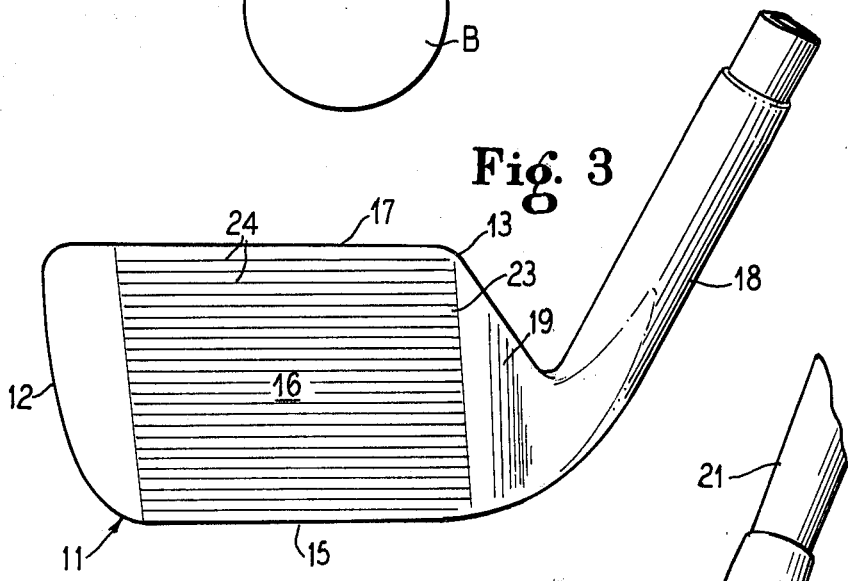
FIG. 3 is a front face view of the blade.

In FIG. 1, the reference numeral 10 designates generally a pitching wedge as an example of the lofted golfing irons of this invention. It will be understood, of course, that the invention includes golfing irons in general, especially those of the high loft type.

The wedge 10 has a metal blade 11 with a free toe end 12 and a heel end 13 of the same height as the toe. The blade has a relatively thick sole 14 with a front bottom edge 15. A striking face 16 extends upwardly and rearwardly from this edge 15 to a thin top edge 17.

The bottom edge 15 and the top edge 17 are parallel, and the toe 12 and heel 13 ends are the same height, and the striking face 16 is generally rectangular.

A hosel 18 is connected through a flattened wide land to the lower portion of the heel 13 with the land being curved into the flat striking face and having an inclined top edge 20 tapered into the top edge 17 of the blade at its heel end.

A shaft 21 has its lower end secured in the hosel 18 and a hand grip 22 is mounted on the top end of the shaft. The shaft is stepped along the length thereof from a small diameter bottom end to a large diameter strip end.

The striking face 16 has a roughened or unpolished central portion 23 extending from the top to the bottom edges, but terminating inwardly from the toe and heel ends, and this roughened portion has spaced parallel grooves along the length thereof. These grooves 24 are parallel with the top and bottom edges 15 and 17.

The shaft is inclined forwardly from the bottom edge 15 of the blade 11 and is also inclined laterally from the heel 13 of the blade. The arrangement is such, as shown in FIG. 1, that when the sole 14 rests on the turf T in addressing a golf ball B, the shaft will be inclined forwardly and laterally from the striking face 16 of the blade. Since the blade has an appreciable height, preferably about two inches for a pitching wedge, the top edge 17 of the blade will be clearly visible to the golfer above the turf T. This edge, being substantially parallel with the turf hidden bottom edge 15, when aligned normal to the intended flight path of the ball B will position the striking face 16 to impact the ball directly on the intended path. Since the heel and toe ends of the blade are substantially the same height an enhanced size striking face is provided to accommodate errors in alignment.

Figure 4:
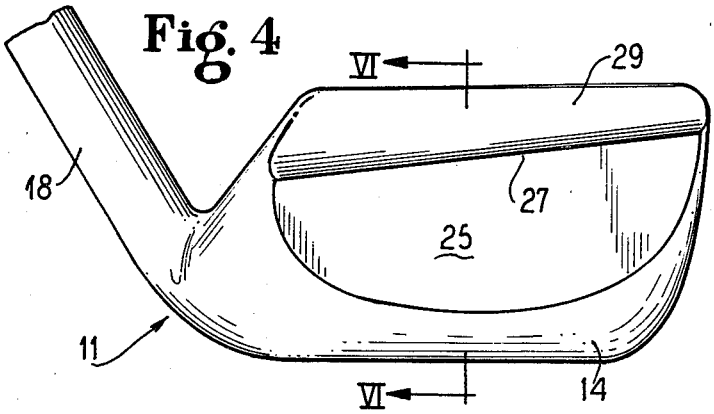
FIG. 4 is a back face view of the blade.
Figure 6:
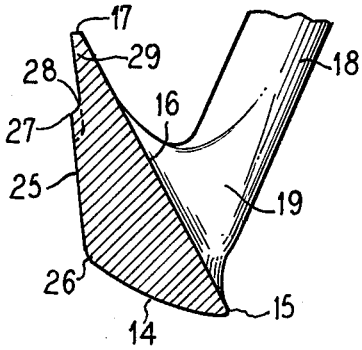
FIG. 6 is a cross-sectional view of the blade along the line VI—VI of FIG. 4.

As shown in FIG. 4, the blade 11 has a back face 25 which, as shown in FIG. 6, is flat and extends from a back bottom edge 26 of the thick sole 14 to a ridge 27 which is inclined from near the top end of the toe 12 to a level about flush with the top end 20 of the hosel land 19. A rounded bevel or filet 28 merges this ridge 27 into a thin top 29 portion of the blade. The thin portion 29 terminates at the top edge 17 of the blade. This arrangement is desirable to lighten the top portion of the blade beyond the hosel connection and to concentrate the weight of the blade in its bottom section.

In addition, the thin top portion 29 provides a thin top sighting edge 17 which is not obscured by a back face such as 25 of the blade. Thus, as shown in FIG. 5, the sighting edge 17 is sharp and well defined with the back face 25 of the blade hidden from the golfer's view.

Figure 5:
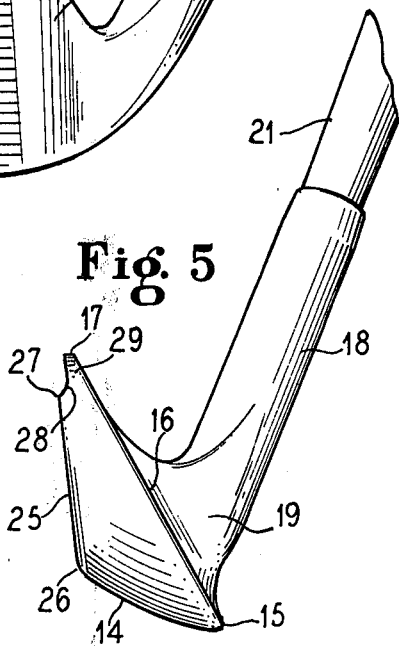
FIG. 5 is a toe end view of the blade.

As also shown in FIG. 5, the sole 14 is inclined upwardly from the front edge 15 to the edge 26 and the inclined face of the sole is curved both longitudinally and transversely to provide a rocker bottom for the blade.

Figure 7:
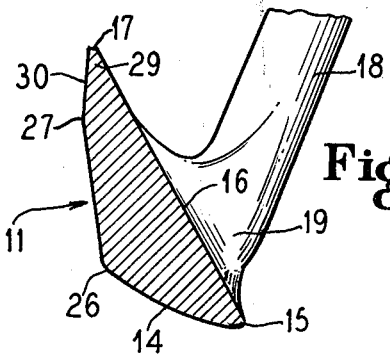
FIG. 7 is a cross-sectional view similar to FIG. 6, but showing a modified construction.

Instead of sharply reducing the thickness of the blade from the ridge 27 through the bevel 28, in the modification of FIG. 7, the back edge of the blade may be tapered at 30 from the ridge line to the top edge 17.

As shown in FIGS. 5–7, the sole 14 is thick, slopes upwardly from the bottom edge 15 to the bottom of the upright back face 25. The front striking face 16 converges from the front bottom edge 15 toward the back face 25 providing an acute angular relationship with the back face. The blade thus has a triangular cross section.

As explained above, the preferred height for the rectangular blade of a pitching wedge of this invention is about two inches. A preferred blade length for such a pitching wedge is about three inches, while a preferred sole depth is about three-quarters of an inch with a preferred top edge width of only about one-eighth of an inch. The striking face 16 is inclined rearwardly so that when the sole 14 is bottomed on the ground, the face will be tilted back from the vertical at a substantial angle. For wedges, angles of from 45° to 75° are useful. These dimensions, of course, will vary for clubs of different lofts, for women's, and men's clubs, and for individual preferences.

From the above descriptions, it will be understood that the golfing irons of this invention provide a true top sighting edge for easily aligning the club to drive the ball on a desired flight path.

I claim as my invention:

1. A lofted golfing iron having a visible top sighting edge on the blade thereof to facilitate alignment of the club for the intended flight path of the ball and having an enhanced size striking face which comprises a blade having heel and toe ends of substantially the same height, a thick bottom sole with a front edge, an upright back face, a top edge parallel with said front edge and an inclined front striking face between said bottom and top edges extending from the heel to the toe ends, a hosel extending upwardly and forwardly from the heel end of the blade, a flattened land connecting the bottom of the hosel with the bottom portion of the heel end of the blade and said top edge of the blade being thinner than the remaining portion of the blade and defining the aforesaid sighting line.

2. The golfing iron of claim 1 wherein the upright back face extends upwardly from the bottom sole to a ridge line extending from the toe to the heel ends of the blade and the upper portion of the back face is stepped toward the striking face to hide the back face from the view of the golfer when aligning the top edge of the blade relative to the ball.

3. The golfing iron of claim 1 wherein the back face extends upwardly from the bottom sole to a longitudinal ridge line between the toe and heel ends of the blade sloping downwardly from adjacent the top edge at the toe end of the blade to the top of the flattened land portion at the heel of the blade and said back face is tapered toward said striking face to provide only a thin sighting line at the top edge of the blade.

4. The golfing iron of claim 1 wherein the thick bottom sole slopes upwardly from said front edge to the bottom of the upright back face.

5. The golfing iron of claim 1 wherein said blade has a generally triangular cross-section with an acute angle at the top edge.

6. The golf club of claim 1 wherein the blade has a height of about two inches and the front face is inclined rearwardly to pitch the ball.

7. A golf club comprising a head having an upright rectangular blade with heel and toe ends, parallel top and bottom front edges, an inclined ball striking front face between said ends and edges, a bottom sole sloping upwardly and rearwardly from said bottom edge, a back face extending upwardly from the upper rear end of said bottom sole in acute angular relation with said front face and with the front face converging rearwardly toward said back face, the upper end of said back face converging toward said top front edge to define therewith a thin sighting line at the top of the blade between said toe and heel ends, a tubular hosel sloping laterally and forwardly from said front face, a flattened upright forwardly inclined land merging the hosel into the heel end of the blade, a tapered shaft having the small end thereof secured to the hosel, and a grip secured around the large diameter end of the shaft, said sole when bottomed on the turf presenting said front face to the ball at an angle for lofting the ball and said thin sighting edge when positioned normal to the desired flight path of the ball presenting said front face to impact the ball for travel on said path.

8. The golf club of claim 7 wherein the back face extends upwardly to an inclined longitudinal ridge line between the toe and heel ends of the blade and is then stepped forwardly from this ridge line to the top edge of the blade.

9. The golf club of claim 7 wherein the blade has a triangular cross-section with an acute angle between the front face and the back face at the top edge of the blade.

10. The golf club of claim 2 wherein the back face rises to a longitudinal ridge line extending from the toe to the heel ends and is tapered toward the front face from said ridge line to said top edge.

11. The golf club of claim 2 wherein said front face has a roughened central area and longitudinal grooves are provided in said area.

* * * * *